US005476132A

United States Patent [19]

Jacobson

[11] Patent Number: 5,476,132

[45] Date of Patent: Dec. 19, 1995

[54] CORDLESS APPARATUS FOR OPERATING BLINDS AND SHADES

[76] Inventor: Jeff A. Jacobson, 4508 Dorchester Rd., Corona del Mar, Calif. 29625

[21] Appl. No.: 413,549

[22] Filed: Mar. 30, 1995

[51] Int. Cl.[6] ..... E06B 9/30

[52] U.S. Cl. ..... 160/168.1; 160/178.1; 160/84.04

[58] Field of Search ..... 160/168.1 R, 168.1 V, 160/176.1 R, 176.1 V, 178.1 R, 178.1 V, 173 R, 173 V, 177 R, 177 V, 84.04, 900, 107, 170 R, 171 R, 104; 74/89.15, 424.8 R, 424.8 A, 424.8 B, 424.8 C, 499, 509

[56] References Cited

U.S. PATENT DOCUMENTS

| | | | |
|---|---|---|---|
| 3,499,477 | 3/1970 | Niwa | 160/168.1 V |
| 4,122,884 | 10/1978 | Salzmann | 160/178.1 V |
| 4,759,398 | 7/1988 | Renee | 160/178.1 R |
| 4,817,698 | 4/1989 | Rossini et al. | 160/168.1 R |

FOREIGN PATENT DOCUMENTS

| | | | |
|---|---|---|---|
| 153833 | 3/1956 | Sweden | 160/178.1 |
| 2164986 | 4/1986 | United Kingdom | 160/178.1 |

*Primary Examiner*—David M. Purol
*Attorney, Agent, or Firm*—Poms, Smith, Lande & Rose

[57] ABSTRACT

Apparatus for cordless operation of blinds. A pair of actuators are in spiral engagement with a spiral wand coupled to rail mechanism from which the blinds depend. One of the actuators rotates in one direction and the other actuators rotates in an opposite direction. Raising or lowering selective ones of the actuators operates the blinds.

13 Claims, 6 Drawing Sheets

11
14
40
10
12
13
16
15

FIG. 3
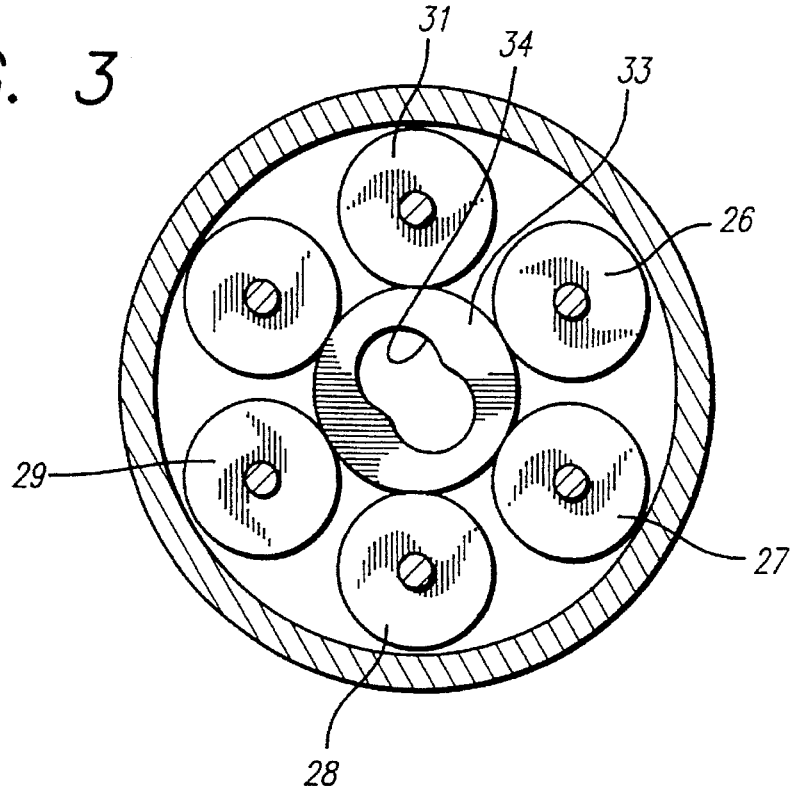
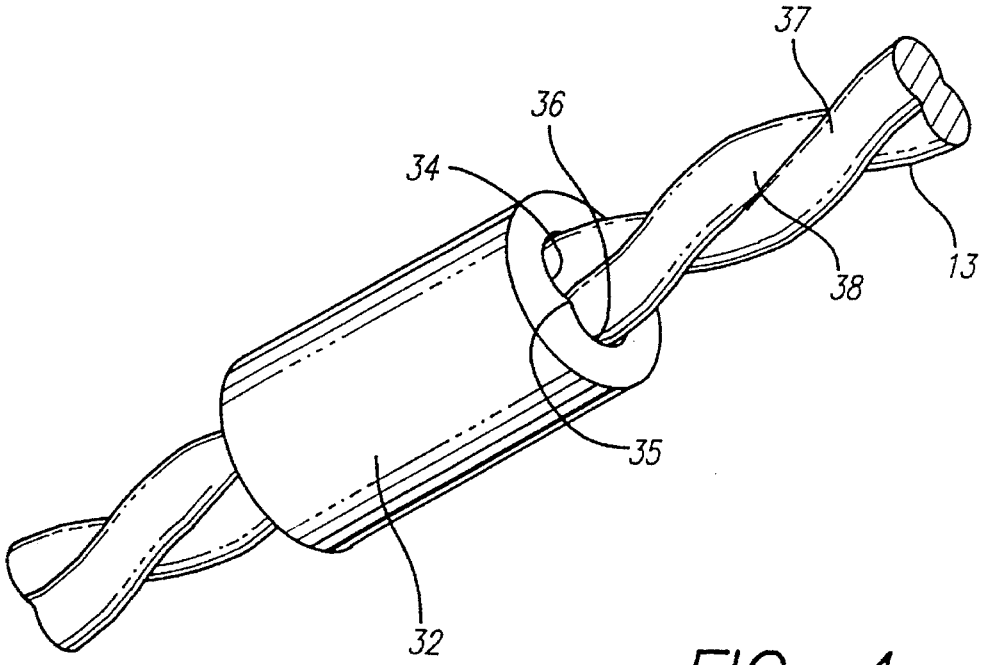
FIG. 4

CORDLESS APPARATUS FOR OPERATING BLINDS AND SHADES

BACKGROUND OF THE INVENTION

1. Field of the Invention

The invention relates to operation of horizontal and vertical blinds or shades, and, more particularly, to cordless operation of such blinds or shades.

2. Description of the Prior Art

At least one child a month is accidentally strangled in window blind or shade operating cords, according to the U.S. Consumer Products Safety Commission. One proposal for solving the problem is to cut the loop in most window blind cords and then affixing safety pulls at the two cut ends. This thus replaces the preexisting loop with safety tassels. This stop gap solution obviously requires education by the consumer and is not applicable to vertical blinds or continuous loop roll up clutch systems. Such blinds must be fixed with tie down devices.

Thus, consumers have resorted to various home remedies to solve these problems, such as clamps or clothes pins to hold the cords, tying the cord to itself, cleats, tie down devices, cord reels, safety breakaway devices, etc. However, all these remedies do not solve the problem. For example, the safety breakaway device may knot into a non-breakaway cord.

A spiral wand having an actuator in contact therewith is disclosed in U.S. Pat. No. 4,759,398 to Renee. However, this device is limited merely to the tilting and rotating of slats only.

Either solution still results in dangling cords which can be dangerous to infants and small children who could still manage to somehow get caught up in such dangling cords.

There is a need for a cordless system for raising and lowering shades and blinds, and for rotating vertical louvers and horizontal slats, as well as traversing vertical blinds, open or closed, without the use of an operating cord.

SUMMARY OF THE INVENTION

It is an object of this invention to provide a cordless apparatus for operating blinds and shades.

It is a further object of this invention to provide cordless apparatus for raising and lowering shades and blinds.

It is still further an object of this invention to provide cordless apparatus for rotating vertical louvers and horizontal slats, as well as traversing vertical blinds.

It is still further an object of this invention to provide a gearing system operational with such cordless operating apparatus.

These and other objects are preferably accomplished by providing a pair of actuators in spiral engagement with a spiral wand coupled to rail mechanism from which blinds or shades depend. One of the actuators rotates in one direction and the other actuator rotates in an opposite direction. Raising or lowering selective ones of the actuator operates the blinds or shades.

BRIEF DESCRIPTION OF THE DRAWING

FIG. 3 is a view taken along lines 3—3 of FIG. 2;

FIG. 4 is a view taken along line 4 of FIG. 3;

DESCRIPTION OF THE PREFERRED EMBODIMENT

Figure 1:
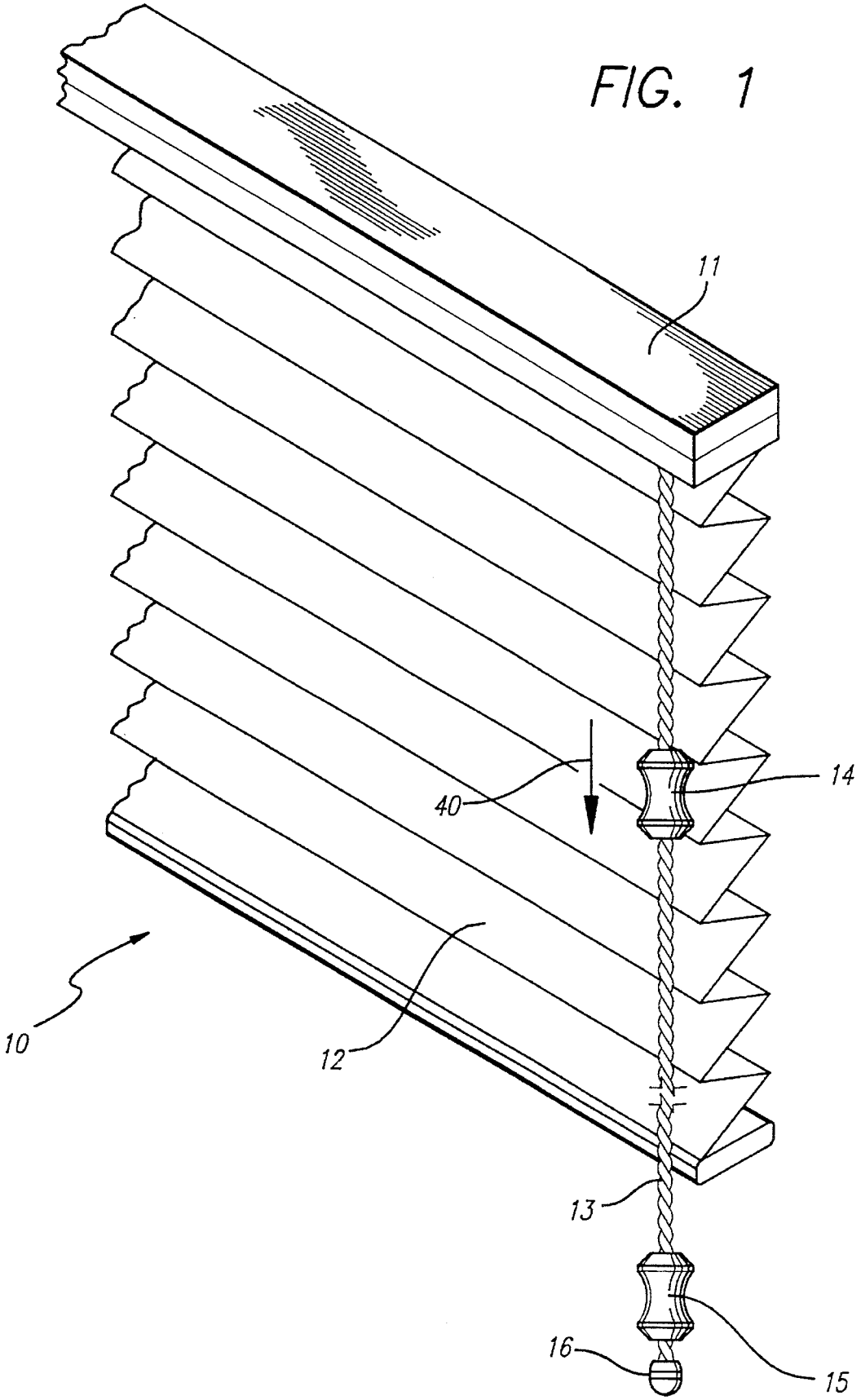
FIG. 1 is a perspective view of a horizontal blind assembly having the actuator of the invention and operating means therefor installed thereon.

Referring now to FIG. 1 of the drawing, a horizontal blind or shade assembly 10 is shown having an upper rail assembly 11 from which a plurality of horizontally disposed and vertically spaced interconnected shades 12 or slats or any covering depend. Although the invention will be described herein with respect to raising, lowering or tilting of horizontal shades or blinds, the teachings are applicable to the opening, closing or rotating of vertical blinds as will be discussed.

Thus, a spiral wand 13 extends downwardly from rail assembly 11 and has a plurality, such as two, of actuators 14, 15 disposed thereon. A terminal stop 16 is provided at the bottom of wand 13.

Figure 2:
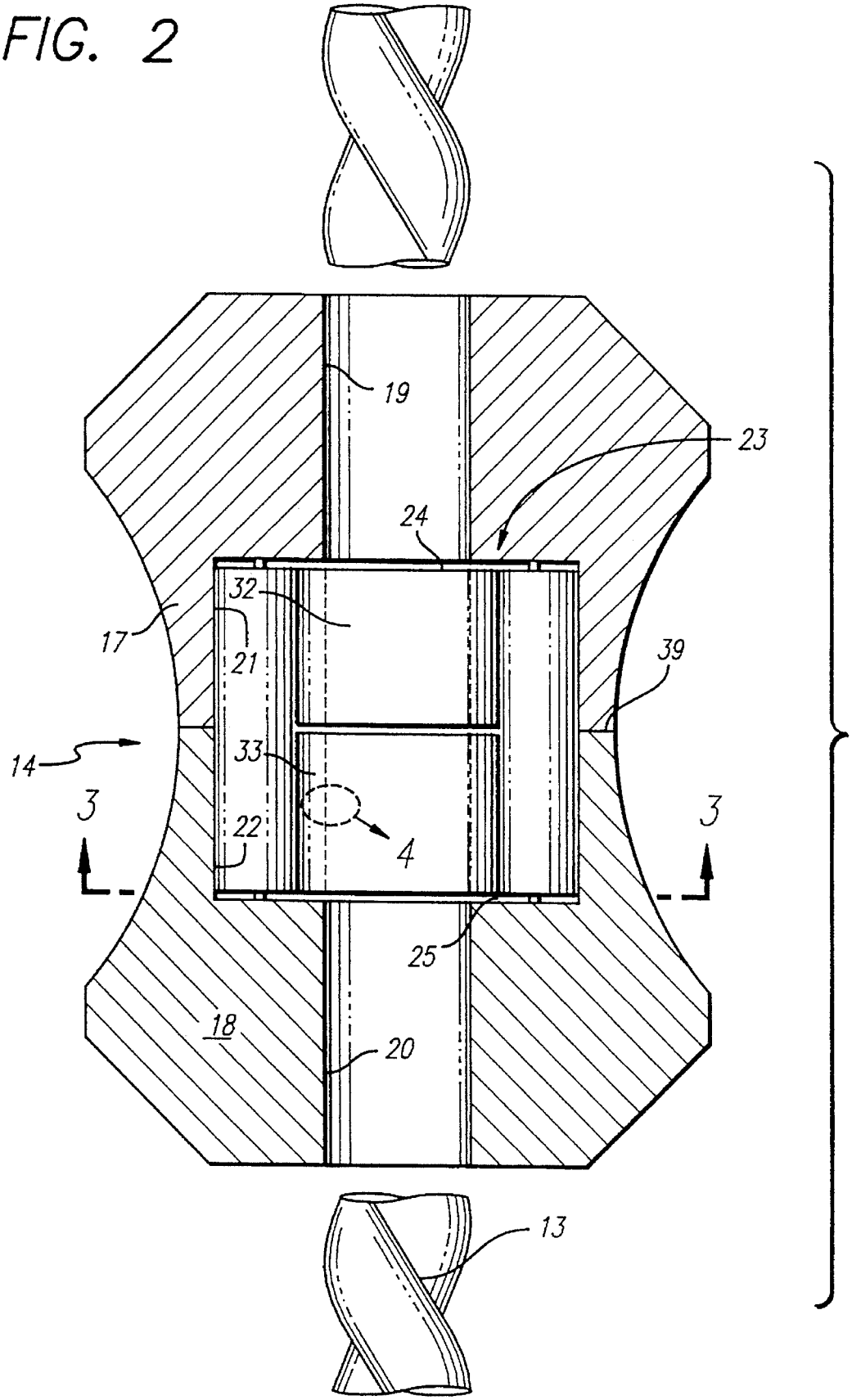
FIG. 2 is an elevational cross-sectional view of a portion of the assembly of FIG. 1.

Spiral wand 13 and one of the actuators 14, 15, such as upper actuator 14, are shown in detail in FIG. 2. Each actuator 14, 15 is essentially identical except as will be discussed. Thus, actuator 14 is comprised of an upper main housing portion 17 secured to a lower main housing portion 18 in any suitable manner, such as by gluing. Each housing portion 17, 18 has a throughbore, as througbores 19, 20, respectively, through which wand 13 passes. Each housing portion 17, 18 also has an inner chamber, as chambers 21, 22, respectively, which serve to retain therein a single directional locking bearing assembly 23. Bearing assembly 23 includes an upper plate 24 and a lower plate 25 with a plurality of bearings, such as bearing 26 through 31 (FIG. 3), journalled for rotation therein about upper and lower drive nuts 32, 33, respectively. Each drive nut 32, 33 has a central bore 34 (FIG. 3), configured similarly to the spiral grooves and ridges of wand 13, as also seen in FIG. 4. Thus, nut 32 has bore 34 with spiral ridges 35 and valleys 36 conforming to the spiral ridges and valleys 37, 38, respectively, on the exterior of wand 13.

As heretofore discussed, bearing assembly 23 is a one way bearing assembly and thus rotates in only one direction. However, the bearing assembly in actuator 14 (FIG. 1) rotates in a direction different from that of the bearing assembly in actuator 15 (for reasons to be discussed).

Thus, rollers 26 through 31 (FIG. 3) are in a tight fitting driving relationship to the outer surface of drive nut 33. The bearing assembly 23 is press-fit inside of mating housing portions 17, 18 (FIG. 2) which are secured together at their junction 39 in any suitable manner, such as by gluing.

In operation, referring to FIG. 1, when actuator 14 is moved upwardly in the direction opposite that of arrow 40, locking nuts 32, 33, which ape always in engagement with wand 13 due to the mating of the respective spiral grooves and ridges spin freely inside of bearing assembly 23 on wand 13 due to the one-way rotation of the bearings therein. However, when it is desired to raise shade or blind 12, actuator 14 is pulled downwardly on wand 13 in the direction of arrow 40 thus raising the shades or blinds 12.

If it is desired to lower the shades 12, the lower actuator 15 is raised upwardly in the direction opposite that of arrow 40 in FIG. 1. This lowers the shades 12 due to the rotation of the bearings in actuator 15 in a direction opposite that of the bearings in actuator 15.

The inner surfaces of the drive nuts must be machined or molded to conform to the outer spiral surface of the wand 13. However, if a single drive nut was used, it might become unstable, wear out quickly and jam up on the wand and not work unless the spiral grooves and ridges therein were perfectly aligned with those on the wand. However, by using two drive nuts in one bearing assembly, as seen in FIG. 2, the drive nuts 32, 33 are self aligning on wand 13 compensating for any imperfections between the grooves and ridges on the wand and those on the drive nuts. Thus, although a single drive nut would work, a plurality of drive nuts, such as two, are preferred for minimum wear and maximum surface engagement which results in more torque and less surface wear.

Thus, actuators 14, 15 each incorporate a single directional bearing assembly with a pair of independent drive nuts that self align or adjust to accommodate varying thread pitches and imperfections on a spiral wand. Such a system is durable and works smoothly in operation. Using a pair of drive nuts in each actuator, rather than one single nut, allows for self aligning and eliminates the need for extremely close tolerances. Using two drive nuts instead of one, which is unstable and wears out quickly, results in the two nuts seeking their own grooves and positioning on the wand. A smooth, stable surface contact takes place as if the two drive nuts were in fact a single long nut.

Figure 5:
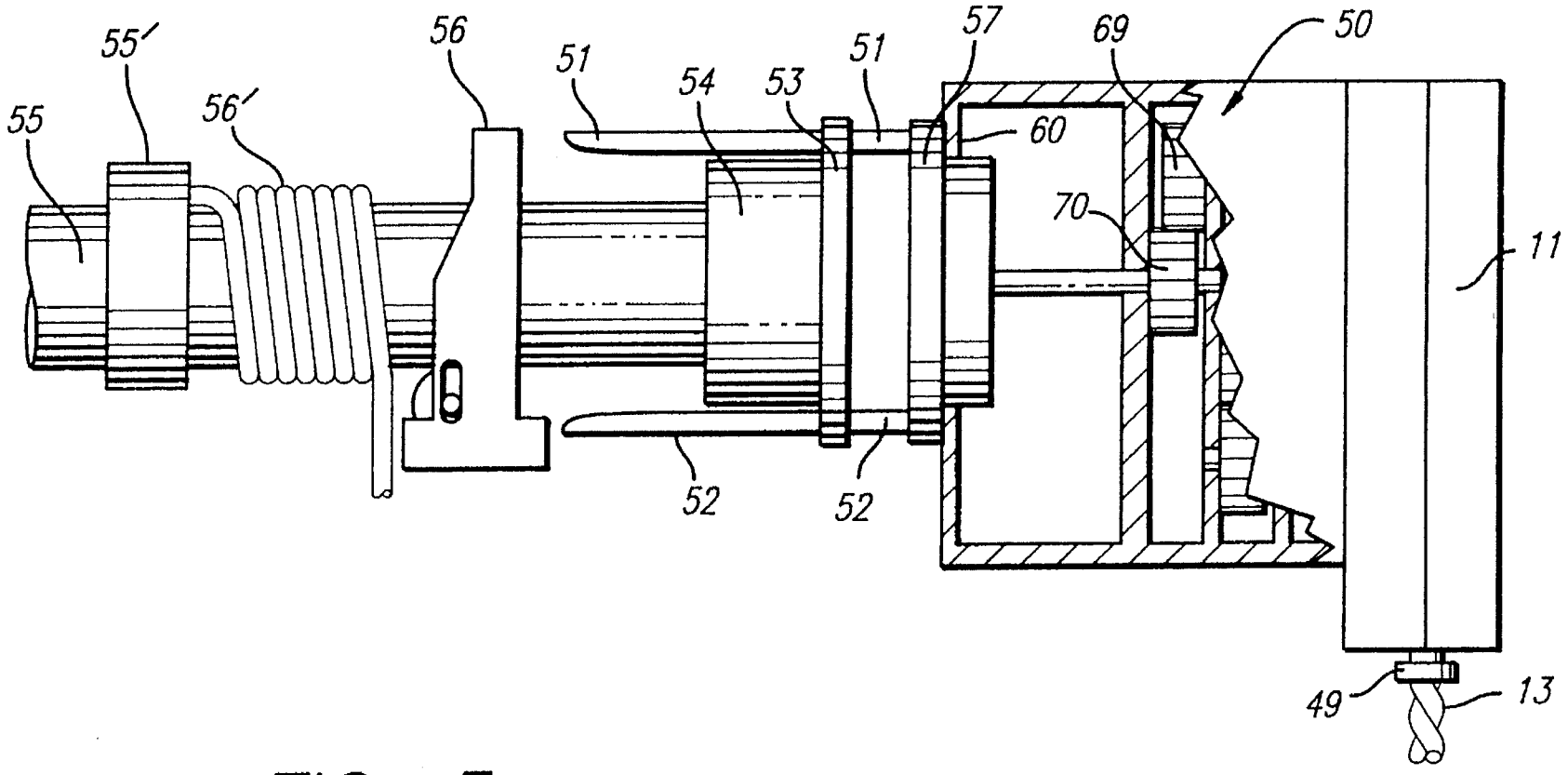
FIG. 5 is an elevational view, partly in section, of a portion of the assembly of FIG. 1.
Figure 6:
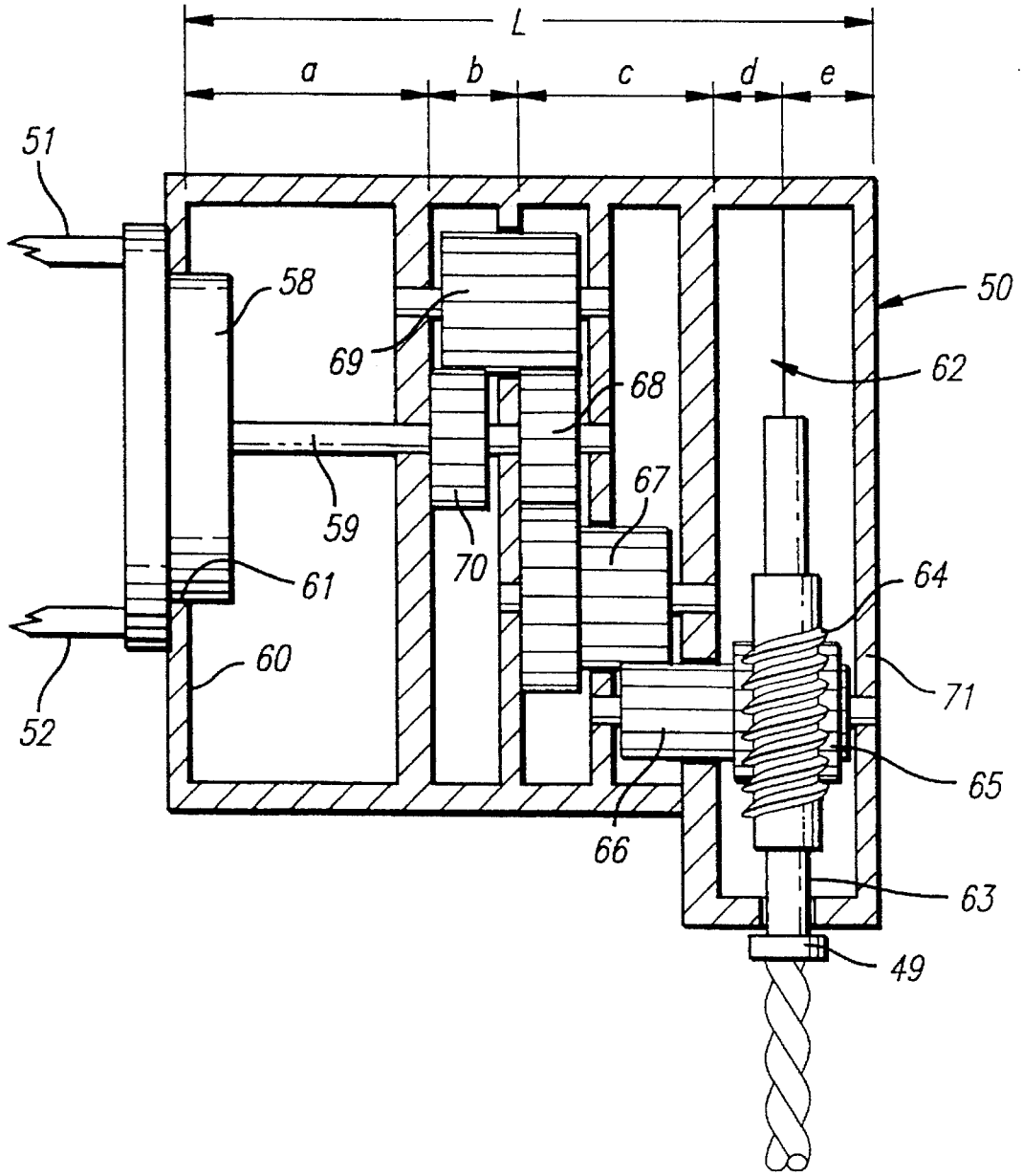
FIG. 6 is a detailed view of the gearing apparatus of FIG. 5.

Although the above wand and actuators may be used to operate any suitable type of horizontal and vertical blinds, as seen in FIG. 6, rail 11 is shown having wand 13 extending thereto. A conventional universal joint 49 couples wand 13 to gear box housing 50 associated with rail 11. Gear box housing 50 is adapted to rotate a pair of spaced prongs 51, 52 extending from and through a disk 53. Disk 53 has a central integral boss 54 having an elongated rod 55 extending therefrom. A clip 55' (FIG. 5) is mounted on rod 55, spaced from boss 54, having an end of string 56' secured thereto. String 56 wraps around rod 55 and has its other end passing through clip 56 down to the uppermost shade 12 (FIG. 1) as is well known in the art.

Prongs 51, 52 extend to plate 57 disposed adjacent the end wall 60 of gear box housing 50. As seen in FIG. 6, plate 57 is coupled through an opening 61 in end wall 60 to a smaller diameter plate 58 which is in turn coupled to output shaft 59 of gearing assembly 62. Thus, rotation of shaft 59 rotates plate 57 having prongs 51, 52 extending therefrom. As an added feature of the invention, it can be seen in FIG. 5 that the wand 13 is spaced from the end of rail 11 so that, when installed, the operator's hands can easily grasp operators 14, 15 without engagement of the wall adjacent wand 13.

Gearing assembly 62 will now be described with reference to FIG. 6. Assembly 62 includes a shaft portion 63 coupling universal joint 49 to a worm gear 64. Worm gear 64 is in meshing engagement with drive gear 65. Gear 65 is in meshing engagement with spur gear 66 which in turn is in meshing engagement with spur gear 67. Spur gear 67 is in meshing engagement with spur gear 68 and spur gear 68 is in meshing engagement with spur gear 69. Spur gear 69 is in meshing engagement with spur gear 70 which is connected to shaft 59 so that rotation of gear 70 rotates shaft 59. The foregoing arrangement provides for resistance to back driving of the gears due to gravity pulling downwardly on a heavy shade or blind. This is accomplished by spacing large gear 69 from the gears 64, 65 using intermediate gearing as described and shown.

As seen in FIG. 6, the preferred spacing L between the end of shaft 59 (where it connects to plate 58) and end wall 71 of gear box housing 50 is about 1.905". The spacing a between the end of shaft 59 and gears 69, 70 may be about 0.625 inches; the spacing b between the ends of gears 69, 70 and the gear 69 may be about 0.260 inches; the spacing c between the forward end of gear 69 and the furthermost end of gear 67 may be about 0.460 inches; the spacing d between the gear 67 and the center axis of worm gear 64 may be about 0.300 inches and the spacing c between the center axis of worm gear 64 and end wall 71 may be about 0.260 inches.

The operation of wand 13 to rotate worm gear 64 has been previously discussed. This in turn, due to the meshing engagement of the various gears 64 through 70, results in rotation of shaft 59. This rotates disk 57 which rotates prongs 51, 52. Shaft 55 is keyed for rotation in boss 54 and thus rotates winding string 56 thereon as disk 53 and integral boss 54 move laterally on prongs 51, 52 as is well known in the venetian blind and shade art. A complete description of such an arrangement is illustrated in FIG. 3 of U.S. Pat. No. 5,228,491, and described in detail therein, the teachings of which are incorporated herein by reference. Thus, the shade 12 of FIG. 1 can be quickly raised and lowered.

Figure 7:
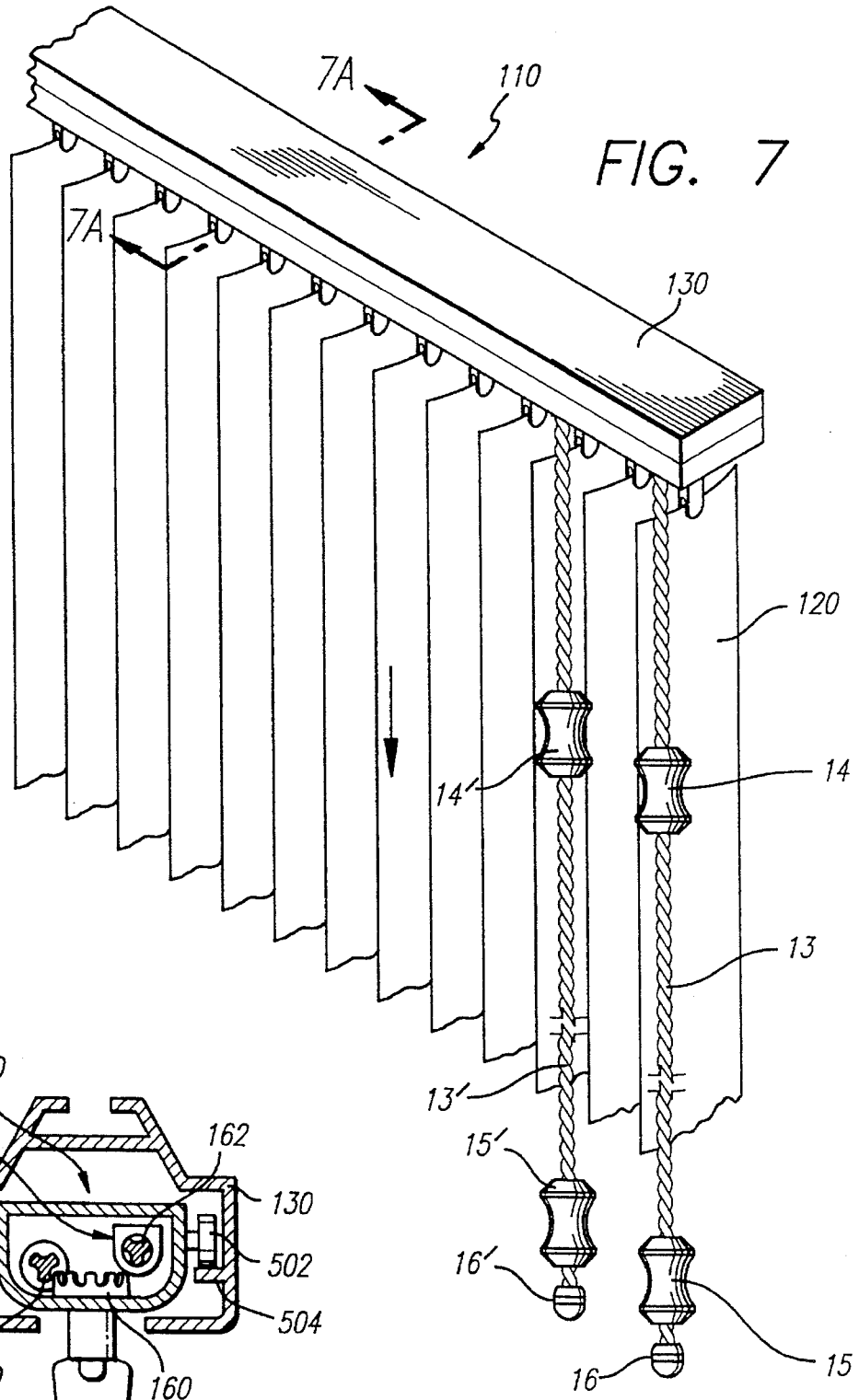
FIG. 7 is a view similar to FIG. 1 showing a vertical blind assembly having the wand and actuators of FIG. 2 installed thereon.
Figure 7A:
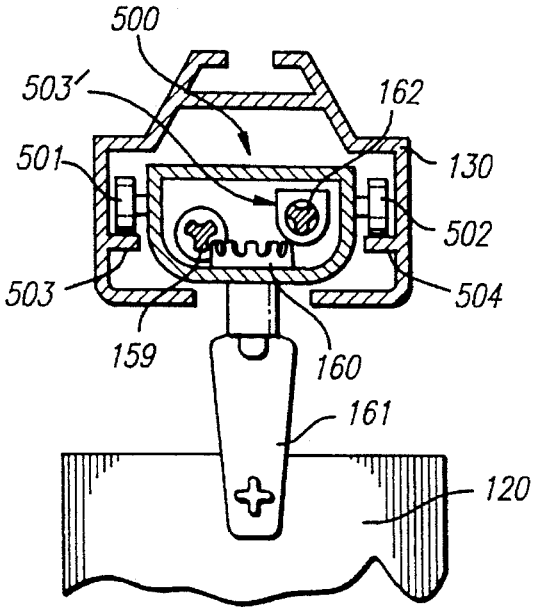
FIG. 7*a* is a detailed view, partly in section, of a portion of the apparatus of FIG. 7.

Although the foregoing has been disclosed with respect to horizontal shades or blinds, as heretofore mentioned, such an arrangement can be used on vertical blinds to open and close the same by rotating the elongated slats. This is shown in FIG. 7 wherein like numerals refer to like parts of the embodiment of FIGS. 1 to 6. Thus, blind assembly 110 has vertically spaced blinds or slats 120 which are operated by the wand 13 and actuators 14, 15 as heretofore discussed. In this embodiment, instead of shaft 59 actuating the prongs 51, 52, shaft 59 is coupled to or comprises a splined or three fluted rod, 159 FIG. 7*a*, such as shaft or rod 19 described in U.S. Pat. No. 4,122,884, which extends lengthwise of the housing 130 and has suitable mechanism therein engaging rod 159, such as rack member 160 coupled to slat or lower clip (parts 160, 161 may be one-piece) 161 having slat 120 connected thereto as is well known in the art and described and illustrated in U.S. Pat. No. 4,122,884 for rotating slats 120, as is well known in the art. The teachings of this patent are thus incorporated herein by reference. Also, as seen in FIG. 7, a second wand 13', identical to wand 13, and stop member 16', identical to stop member 16, may be provided spaced from wand 13. Wand 13' also has spaced actuators 14', 15', identical to actuators 14, 15. Wand 13' can be used to traverse carriers, such as carrier 500 (FIG. 7*a*), which slides (through which rod 159 extends) via wheels 501, 502, in tracks 503, 504, respectively, of housing 130 as is well known in the art. Such carrier housings inherently have a carrier drive nut 503' extending therethrough with a spirally fluted rod 162 therein. By spinning rod 13' (FIG. 7), carriers 500 are traversed back and forth along tracks 503, 504 of housing 130 as is well known in the art. Rod 13 may be coupled to spiral fluted rod 162 in the same manner as three fluted rod 159 or by any suitable means known in the vertical slat art. Added gearing means identical to gearing means 62, may be provided to rotate rod 159.

The invention herein eliminates potentially dangerous cords and is safe and easy to use. There are no tangled piles of cords to deal with and the apparatus is easy to raise, lower, and position the shade or blind at the exact height desired.

Shades and blinds glide open and closed evenly; shades and blinds stay level. The apparatus herein raises heavy blinds with less effort than with cords and the shades stop exactly where one releases the operator. The apparatus allows one to set the shades or blinds at the same level as adjacent shades or blinds.

For vertical shades or blinds, there is no need to guess which cord does what function. Each wand and actuator's function is clearly identifiable. The wands and operators, for example, although made of any suitable materials, may be differentiated for ease of identification by marking one wand of clear plastic and the other wand of steel or other suitable material. Contrasting colors may be also be used. The clear wand, using one actuator, may be for rotating the louvers; the steel wand, with two actuators, may be for traversing the blinds open and closed.

Although a specific embodiment of the invention has been disclosed, variations thereof may occur to an artisan and the scope of the invention should only be considered limited by the scope of the appended claims:

I claim:

1. Apparatus for operating horizontal blinds or shades and vertical blinds comprising:

actuating means coupled to said blinds or shades for selectively moving the same;

an elongated spiral wand coupled to said actuating means having a plurality of actuators in spiral engagement therewith, one of said actuators being disposed above the other and each actuator having a one-way bearing assembly mounted therein, the bearing assembly in one actuator rotating in a direction opposite that of the bearing assembly in the other actuator, each of said bearing assemblies being in driving engagement with at least one drive nut encircling said wand and in spiral engagement therewith whereby movement of one actuator along said wand rotates said wand in one direction and movement of the other actuator along said wand rotates said wand in a direction opposite that of the said one actuator.

2. In the apparatus of claim 1 wherein a pair of drive nuts are in driving engagement with said wand in each said actuator.

3. In the apparatus of claim 1 wherein said at least one drive nut is round about its exterior when it engages said bearing assembly.

4. In the apparatus of claim 1 wherein said at least one drive nut has a throughbore configured to spiralled grooves and ridges on said wand.

5. In the apparatus of claim 1 wherein said actuating means includes a gearing assembly, said gearing assembly having a worm coupled to said wand in driving engagement with a worm gear, said worm gear being in driving engagement with a first spur gear of a first diameter, said first spur gear being in driving engagement with a second spur gear of a second diameter, said second spur gear being in driving engagement with a third spur gear, said third spur gear being in driving engagement with a fourth spur gear, said fourth spur gear being in driving engagement with a fifth spur gear having an output shaft extending outwardly from the center thereof, said output shaft being coupled to said blinds or shades.

6. In the apparatus of claim 5 including a universal joint coupling said wand to said worm.

7. In the apparatus of claim 5 wherein said second diameter is substantially greater than said first diameter.

8. In the apparatus of claim 7 wherein said output shaft is coupled to a pair of spaced prongs for rotating the same, said spaced prongs extending through a disk having an elongated rod keyed for rotation therewith and extending along a head rail containing said actuating means therein, said shades or blinds extending downwardly therefrom, and an elongated cord coupled to said shades or blinds wound about said rod and adapted to wind thereabout when said disk is rotated.

9. In the apparatus of claim 1 wherein said actuating means is mounted in a head rail, said wand being spaced inwardly from one end thereof.

10. In the apparatus of claim 5 wherein said actuating means is mounted in a head rail and said output shaft is coupled to individual blinds extending downwardly therefrom at spaced locations along said head rail, said output shaft having blind rotation means at spaced locations therealong adapted to transmit rotation of said shaft into rotation of said blinds.

11. In the apparatus of claim 10 wherein said actuating means includes a second wand having a plurality of said actuators in spiral engagement therewith, each of said last-mentioned actuators having a one-way bearing assembly mounted thereon, one of said last-mentioned assemblies rotating in one direction and one of said last-mentioned assemblies rotating in the opposite direction whereby said last-mentioned second wand is coupled to a spiral fluted rod extending through a drive nut of a plurality of carriers having spaced blinds coupled thereto and rotation of said second wand traverses said blinds.

12. Apparatus for operating horizontal blinds or shades and vertical blinds comprising:

actuating means coupled to said blinds or shades for selectively moving the same;

an elongated spiral wand coupled to said actuating means having at least one actuator in spiral engagement therewith, said at least one actuator having a one-way bearing assembly mounted therein, the bearing assembly in said at least one actuator rotating in a single direction, said bearing assembly being in driving engagement with at least one drive nut encircling said wand and in spiral engagement therewith whereby movement of said at least one actuator along said wand rotates said wand in one direction.

13. In the apparatus of claim 12 wherein a pair of drive nuts are in driving engagement with said wand in said at least one actuator.

* * * * *